US006492893B2

(12) United States Patent
De Graaf

(10) Patent No.: US 6,492,893 B2
(45) Date of Patent: Dec. 10, 2002

(54) METHOD OF MANUFACTURING A SUBSTANTIALLY CLOSED CORE, CORE, AND MAGNETIC COIL

(75) Inventor: Martinus Johannes Maria De Graaf, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/759,035

(22) Filed: Jan. 11, 2001

(65) Prior Publication Data

US 2002/0056186 A1 May 16, 2002

(30) Foreign Application Priority Data

Jan. 12, 2000 (EP) ..... 00200102

(51) Int. Cl.[7] ..... H01F 27/28

(52) U.S. Cl. ..... 336/229; 336/192; 336/198; 336/229; 29/602.1; 29/608

(58) Field of Search ..... 336/229, 192, 336/198, 208; 29/608, 602.1, 605, 606, 607

(56) References Cited

U.S. PATENT DOCUMENTS 6,031,443 A * 2/2000 Larsen ..... 336/192
6,243,940 B1 * 6/2001 Rund et al. ..... 29/608
6,246,172 B1 * 6/2001 Bizen et al. ..... 315/5.41

* cited by examiner

*Primary Examiner*—Michael Friedhofer
*Assistant Examiner*—Jennifer A. Poker
(74) *Attorney, Agent, or Firm*—Ernestine C. Bartlett

(57) ABSTRACT

A coil includes a toroid with a first gap having a gap width smaller than 1.5 mm. The toroid is at least partly coated with a first polymer. Preferably, the toroid has a second gap which can be coated with a second polymer. This toroid can be manufactured by the method of the invention, which includes providing the gap, subsequently covering the gap and at least neighboring portions of the toroid with a polymer coating, and then providing the second gap.

6 Claims, 1 Drawing Sheet

METHOD OF MANUFACTURING A SUBSTANTIALLY CLOSED CORE, CORE, AND MAGNETIC COIL

BACKGROUND OF THE INVENTION

The invention relates to a method of manufacturing a geometrically substantially closed core provided with a first gap which is at least partly filled, which core is mechanically stable and suitable for use in a magnetic coil.

The invention also relates to a core which is substantially closed and provided with a first gap which is at least partly filled, which core is mechanically stable and suitable for use in a magnetic coil.

The invention further relates to a magnetic coil comprising a core and a number of turns, which coil is geometrically substantially closed and provided with a first gap which is at least partly filled.

Such a magnetic coil is known from EP-A 821375. The core of the known coil comprises a highly permeable material such as a ferrite. A stiff epoxy material is introduced into the first gap, whereby the noise generation is reduced.

A disadvantage of the known coil is that the epoxy material is to be placed in the gap and is to be retained to the core by means of an adhesive. This placement is effected mechanically and involves a considerable cost.

BRIEF SUMMARY OF THE INVENTION

It is a first object of the invention to provide a method of manufacturing a core of the kind described in the opening paragraph which is simpler.

It is a second object of the invention to provide a core of the kind mentioned in the opening paragraph which has good characteristics and can be inexpensively manufactured.

It is a third object of the invention to provide a magnetic coil of the kind mentioned in the opening paragraphs in which the above disadvantages are counteracted.

The first object is achieved in that the method comprises the following consecutive steps:

the provision of the first gap in the core with a gap width of at most 1.5 mm, and coating of the core and of the first gap with a layer of a first synthetic resin.

It was found that the first gap in the core can be fully closed by the application of a protective layer of the first synthetic resin, provided the gap is narrow enough. A sufficiently narrow gap is a gap having a width of at most 1.5 mm. A core with a gap having such a gap width is preferably used in the case of cores having diameters smaller than approximately 25 mm. The first synthetic resin has a small, preferably negligibly small magnetic susceptibility and preferably has a melting temperature which is at least 10 to 30 degrees higher than the continuous operational temperature of a magnetic coil in which the core is to be used. Many known synthetic resins are suitable for use as the first synthetic resin. The first synthetic resin is, for example, a polyamide with a melting temperature of approximately 150° C. The first synthetic resin forms a layer around the core which need not be adhered to the core anymore. It is not necessary for the layer to fill the first gap entirely; by enveloping the first gap it prevents first of all that turns of the coil are passed through the first gap, which would make the coil useless, when the core is used in a magnetic coil. In addition, the layer provides a higher mechanical stability against vibrations because the layer fixes the positions of the edges of the core on either side of the gap.

An advantage of the use of the first synthetic resin is that this type of material is electrically insulating and forms a protective layer which prevents electrical contact between the core, which is preferably made of ferrite, and the turns. This renders it unnecessary to apply a supplementary protective layer. The absence of a supplementary protective layer eliminates a step in the manufacture and increases the quantity of material of high magnetic permeability in the core at unchanged dimensions.

In an embodiment, the method according to the invention comprises the provision of a second gap in the core after the core and the first gap have been coated. It was surprisingly found that the core with its first gap coated with a layer of the first synthetic resin is mechanically so strong that a second gap can be provided therein without the core becoming deformed. It is in fact important for the operation of the core that the gap width does not change. It is accordingly possible to provide a second gap in the coated core. If a core has two gaps, each of the gaps can be made narrower. A core having narrower gaps is preferred because the magnetic field widens as the width of a gap increases and because this widening leads to energy losses in the operation of a coil provided with a core. The second gap may be provided, for example, in that the core is incised with a diamond saw, as can indeed the first gap. The gap width can be adjusted in this operation.

It is favorable when at least the second gap and an adjoining portion of the core are coated with a layer of a second synthetic resin. Coating of the second gap has the same advantages as coating of the first gap, inter alia the fixation of the gap width, insulation of the ferrite, fixation of the turns, provision of mechanical stability, and the possibility of providing an additional gap. Preferably, the gap widths in a core having two gaps are chosen to be smaller by a factor two as compared with a core having one gap. It may be that the first gap and the second gap have the same gap width. It is furthermore possible that not the entire core is coated with a layer of the second synthetic resin but that this synthetic resin is applied selectively.

In a further embodiment of the method according to the invention, the second synthetic resin is a material having a melting temperature which lies between the operational temperature of the core in the magnetic coil and the melting temperature of the first synthetic resin. The second synthetic resin in this embodiment may be provided by means of a powder coating technique. In this case, the ferrite core is preheated to above the melting temperature of the second synthetic resin, whereupon the second synthetic resin is provided in powder or suspension form on the core, melts thereon, and forms a layer. To safeguard the characteristics of the core in the long term, it is stipulated that the melting temperature of the second synthetic resin must lie at least 10 to 30° C. above said operational temperature. An operational temperature of 50 to 100° C. is usual for a ferrite core, depending furthermore on the application of the magnetic coil in which the core is incorporated.

In another embodiment of the method according to the invention, the layer of the second synthetic resin is provided through the application of a curable material, which material is subsequently cured. Examples of curable materials are inter alia acrylates and epoxides. A reaction can be initiated in the layer through the supply of heat or ultraviolet radiation after the core has been coated. The use of ultraviolet radiation as an initiator means that the melting temperature is less relevant. The curable material is applied, for example, by immersion. Preferably, not the entire core is coated with the second synthetic resin.

In an alternative embodiment, the method according to the invention comprises the following steps prior to the provision of the first gap:

the provision of a third gap in the core, and coating of at least said third gap and an adjoining portion with a layer of a third synthetic resin.

In this embodiment, the layer of the first synthetic resin is not provided as the first layer, but preferably as the final layer. This provides the advantage that the uninterrupted layer of the first synthetic resin forms an additional protective layer for the core and for the gaps in the core.

It is furthermore possible to manufacture a core with several gaps in a simple manner through a suitable choice of synthetic resins of various melting temperatures, each lying above the continuous operational temperature. A third synthetic resin which may be used is, for example, parylene, the first synthetic resin may be polyamide, and the second a polyalkylene.

The second object of the invention is realized by means of a core of the kind mentioned in the opening paragraphs in that the first gap is coated with a layer of a first synthetic resin which covers the core at least partly and seals off the first gap.

The third object of the invention is realized by means of a magnetic coil of the kind mentioned in the opening paragraphs in that a first layer is present which covers the core at least partly and at the same time closes off the first gap. The core of such a magnetic coil may be manufactured by the method according to the invention. The core may be annular, or alternatively rectangular. An example of a rectangular core is the core such as used in integrated inductive components. Preferably, the core is a ferrite ring or toroidal core with a diameter of less than 15 mm. A magnetic coil with a toroidal core of such a size is small enough for use in a wide variety of modern, preferably portable devices. Usual sizes are outer diameters of approximately 4 and 9 mm. Preferred gap widths are 0.050; 0.100; 0.250; 0.500; and 1.0 mm. Preferably, the core comprises a ferrite material such as MnZn, NiZn, and MgZn. The layer comprises a synthetic resin. Advantages of synthetic resins include their elasticity, low mass, electrical insulation, chemical and magnetic inertia, low cost price, and flexibility in applying techniques. An example of a material is polyamide. The number of turns is usually between 10 and 100. It is possible for primary turns and secondary turns to be present around the core.

Furthermore, a second gap may be present. The angle enclosed by the first and the second gap is variable. An advantage of this angle variation between 5 and 355 degrees is the greater degree of freedom in design and production methods. A further advantage is that the core may comprise more than two gaps, in particular an odd number. This is in contrast to the toroidal core for a magnetic coil known from B. D. Wiese & G. E. Schaller, *The Micro-Gapped Toroid, A New Magnetic Component* (Ceramic Magnetics Inc.). This toroidal core with a diameter smaller than 15 mm comprises two gaps which enclose an angle of 180° with one another. The gaps of this toroidal core are found to be filled up with a foil fastened to the core with glue. The core is cut through into two halves in the manufacture of this toroidal core. Then the first and the second half of the core are placed against one another again, a foil being provided between the two halves. The foil is adhered to the core with glue. Then the foil is cut off in the shape of the core. A disadvantage of this toroidal core is the placement of the two halves of the core onto one another. This placement is a labor-intensive job and involves the risk that the positioning is not accurate enough, so that the toroidal core is magnetically below par.

BRIEF DESCRIPTION OF THE SEVERAL VIEWS OF THE DRAWING

These and other aspects of the invention will be explained in more detail with reference to the drawings, in which.

DETAILED DESCRIPTION OF THE INVENTION

Figure 1:
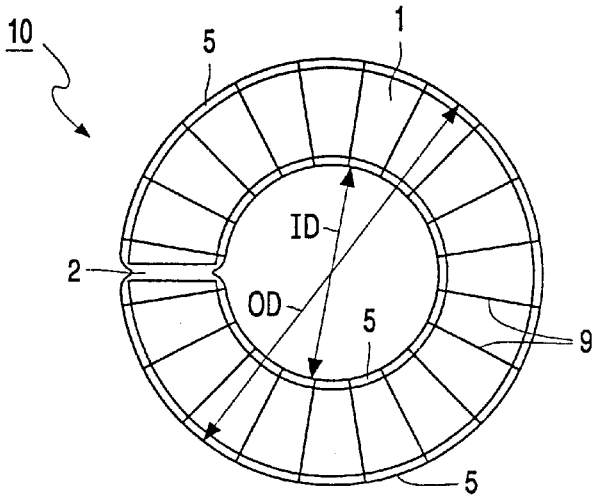
FIG. 1 is a diagrammatic plan view of a coil with a core according to the invention.
Figure 2A:
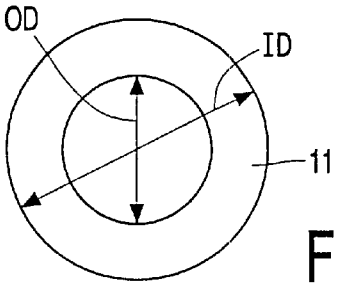
FIG. 2 shows a number of steps in the method for the manufacture of a core according to the invention.
Figure 2B:
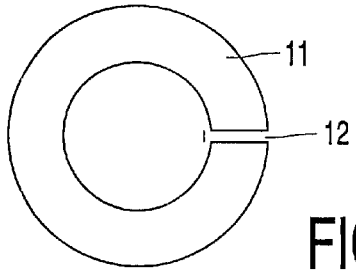
Figure 2C:
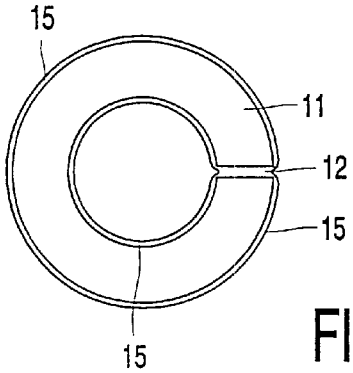
Figure 2D:
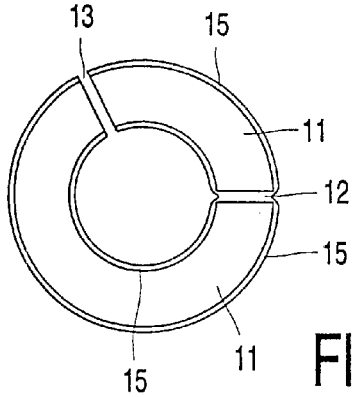
Figure 2E:
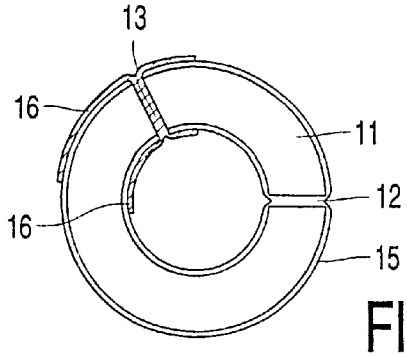

The coil 10 in FIG. 1 comprises a toroidal core 1 of NiZn with an outer diameter OD of 9 mm, an inner diameter ID of 6 mm, and a thickness of 2.5 mm. A first gap 2 is provided in the toroidal core 1. The gap has a width of 0.5 mm. The toroidal core 1 and the first gap 2 are coated with a layer 5 of polyamide, air being enclosed in the first gap 2 thereby. The coil 10 has twenty turns 9.

FIG. 2 shows the initial situation and the result of four steps in a first embodiment of the method of manufacturing a core 11 according to the invention provided with gaps. The initial situation is a toroidal core 11 with an outer diameter OD of 4 mm, an inner diameter ID of 2 mm, and a thickness of 1 mm. A first gap 12 with a width of approximately 0.05 mm is provided in the toroidal core 11 by means of a diamond saw. This is done in that a large number of toroidal cores are placed one behind the other in a rack and are cut in one operation. The toroidal core 11 and the first gap 12 are subsequently coated with a layer 15 of polyamide. To achieve this, the toroidal core 11 is preheated to 300° C. and then immersed in a fluid bed reactor containing a synthetic resin at room temperature. The toroidal core 11 remains in the reactor for 30 to 240 seconds, whereby a layer of approximately 0.1–0.4 mm thickness is formed. Then a second gap 13 is provided in the toroidal core 11 with a diamond saw. This gap 13 has a width of 0.05 mm. The second gap 13 is coated with a layer 16 of a copolymer of poly(methylmethacrylate) and poly(ethylacrylate) by immersion.

What is claimed is:

1. A method of manufacturing a geometrically substantially closed core having a first gap which is at least partly filled, wherein said core is mechanically stable and suitable for use in a magnetic coil, comprising the consecutive steps of:

providing the first gap with a gap width of at most 1.5 mm, then coating the core and the first gap with a layer of a first synthetic resin, and then providing a second gap in the core.

2. A method as claimed in claim 1, characterized in that at least the second gap and an adjoining portion of the core are coated with a layer of a second synthetic resin.

3. A method of manufacturing a geometrically substantially closed core having at least two gaps, wherein said core is mechanically stable and suitable for use in a magnetic coil, comprising the consecutive steps of:

providing one said gap in said core with a gap width of at most 1.5 mm, then coating the one said gap and an adjoining portion of the core with a layer of a first synthetic resin, and then providing another gap in the core, and then coating the core and the another gap with a layer of a second synthetic resin.

4. A method as claimed in claim 3, characterized in that the first synthetic resin is a material with a melting temperature which is higher than the melting temperature of the second synthetic resin.

5. A core which is geometrically substantially closed having at least two gaps, wherein said core is mechanically stable and suitable for use in a magnetic coil, comprising:

a layer of a synthetic resin coating said core and one of said gaps, and a layer of a different synthetic resin coating the other of said gaps and an adjoining portion of the core.

6. A core as claimed in claim 5, characterized in that at least one of said gaps is at least partly filled.

* * * * *